US005133241A

United States Patent [19]

Koyama et al.

[11] Patent Number: 5,133,241

[45] Date of Patent: Jul. 28, 1992

[54] ELECTROMAGNETIC RAIL LAUNCHER

[75] Inventors: Kenichi Koyama; Hideaki Toya, both of Amagasaki, Japan

[73] Assignee: Mitsubishi Denki Kabushiki Kaisha, Japan

[21] Appl. No.: 731,417

[22] Filed: Jul. 17, 1991

[30] Foreign Application Priority Data

Jul. 20, 1990 [JP] Japan ..... 2-193781

[51] Int. Cl.[5] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 4,796,511 | 1/1989 | Egssa | 89/8 |
| 4,945,810 | 8/1990 | Parker | 89/8 |
| 5,040,478 | 9/1991 | Juston et al. | 89/8 |
| 5,060,552 | 10/1991 | Reynolds | 89/8 |

FOREIGN PATENT DOCUMENTS

| | | | |
|---|---|---|---|
| 43055 | 2/1989 | Japan . | |
| 2236835 | 4/1991 | United Kingdom | 89/8 |

OTHER PUBLICATIONS

J. W. Parker, "The SRS Railgun: A New Approach to Restrike Control", IEEE Transactions on Magnetics, vol. 25, No. 1, Jan. 1989, pp. 412–417.

*Primary Examiner*—Stephen C. Bentley

*Attorney, Agent, or Firm*—Wolf, Greenfield & Sacks

[57] ABSTRACT

An electromagnetic rail launcher adapted to accelerate a projectile by an electromagnetic force which comprises:

a plurality of rail-like electrodes; and an armature being installed so as to shortcircuit the plurality of rail-like electrodes;

at least one of said plurality of electrodes being consisted of a first conductive part which contacts with the armature and a second conductive part which is electrically insulated with the first conductive part;

said first conductive part being segmented in a plurality of segmented first conductive parts which are insulated with each other, in an acceleration direction of the projectile;

each of said plurality of the segmented first conductive parts having at least one hole through which the first conductive part and the second conductive part are bridged by an arc, when a current flows in the second conductive part.

1 Claim, 6 Drawing Sheets

ELECTROMAGNETIC RAIL LAUNCHER

BACKGROUND OF THE INVENTION

This invention relates to an electromagnetic rail launcher utilizing an acceleration propulsion system which propels an object in use of an electromagnetic force.

FIG. 10 is a perspective view showing a conventional electromagnetic rail launcher which is disclosed, for instance, in Japanese Unexamined Patent Publication No. 43055/1989. In FIG. 10, a numeral 1*a* signifies a rail-like electrode, 1*b*, another rail-like electrode juxtaposed in parallel with the rail-like electrode 1*a*, 2, an armature disposed between the rail-like electrodes 1*a* and 1*b*, which electrically shortcircuits the rail-like electrode 1*a* and the rail-like electrode 1*b* juxtaposed in parallel with the rail-like electrode 1*a*, and 3, a projectile disposed between the rail-like electrodes 1*a* and 1*b*, and in front of the armature 2 in the drive direction shown by the arrow mark 5. A numeral 4 designates a power supply source which supplies electricity to an electric current passage constituted by the rail-like electrodes 1*a* and 1*b*, and the armature 2. The armature 2 and the projectile 3 may be combined into one body, or may be the same body.

Next explanation will be given to the operation. When electric current flows from the power supply source 4 to the rail-like electrode 1*a*, to the armature 2, and to the rail-like electrode 1*b*, a magnetic field is generated between the rail-like electrodes 1*a* and 1*b* by the electric current which flows between the rail-like electrodes 1*a* and 1*b*. The armature 2 is driven in the direction shown by the arrow mark 5 by receiving a force by an interaction between the magnetic fields and the electric current which flows in the armature 2. Since the projectile 3 is disposed in front of the armature 2 in the direction of the arrow mark 5, the projectile 3 is pushed by the armature 2 and driven in the direction of the arrow mark 5. A driving force works on the projectile 3 during a period in which an electric current flows from the power supply source 4, and the velocity of the projectile 3 is accelerated. Although not shown in FIG. 10, walls made of an insulation material are installed surrounding the both sides of the two rail-like electrodes 1*a* and 1*b*.

Since a conventional electromagnetic rail launcher is constituted as above, in the acceleration process of the projectile and the armature, a high electric voltage is generated between the rail-like electrodes on the side of the introduction of the electric current, with respect to the moving armature, which causes a destruction of insulation, and generates an arc. Therefore, a part or the total of electric current supplied by the power source flows in the arc which decreases the driving force working on the projectile, and decreases the acceleration thereof.

SUMMARY OF THE INVENTION

It is an object of the present invention to provide an electromagnetic rail launcher capable of preventing generation of the high electric voltage between the rail-like electrodes on the side of the introduction of electric current, with respect to the moving armature, and preventing the insulation destruction between the rail-like electrodes.

According to an aspect of the present invention, there is provided an electromagnetic rail launcher adapted to accelerate a projectile by an electromagnetic force which comprises:

a plurality of rail-like electrodes; and an armature being installed so as to shortcircuit the plurality of rail-like electrodes;

at least one of said plurality of electrodes being consisted of a first conductive part which contacts with the armature and a second conductive part which is electrically insulated with the first conductive part;

said first conductive part being segmented in a plurality of segmented first conductive parts which are insulated with each other, in an acceleration direction of the projectile;

each of said plurality of the segmented first conductive parts having at least one hole through which the first conductive part and the second conductive part are bridged by an arc, when a current flows in the second conductive part.

DESCRIPTION OF PREFERRED EMBODIMENTS

Figure 1A:
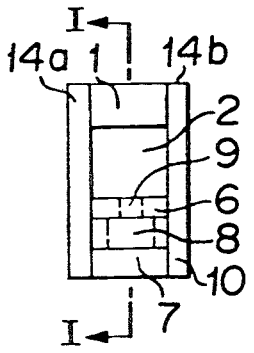
FIGS. 1A and 1B are a side view and a sectional diagram, respectively, showing an embodiment of an electromagnetic rail launcher according to the present invention.
Figure 1B:
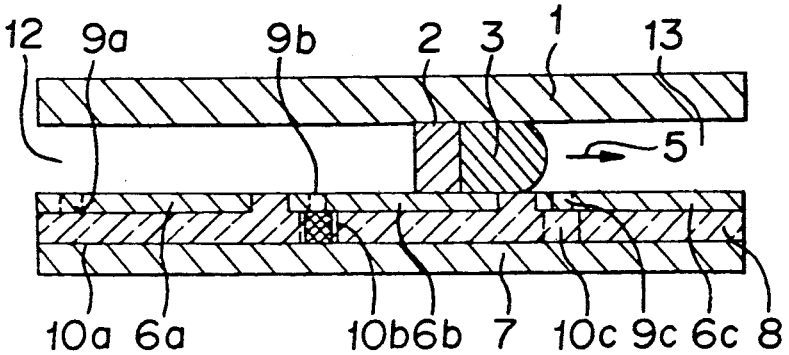

An embodiment of this present invention will be explained referring to the drawings, wherein the same reference numerals designate the same or the corresponding parts. FIG. 1A is a side view showing an embodiment of an electromagnetic rail launcher according to the present invention, and FIG. 1B is a sectional diagram taken along the line I—I of FIG. 1A of FIG. 1A. In FIGS. 1A and 1B, a numeral 1 signifies a rail-like electrode, disposed so as to contact with the projectile 3 and the armature 2. A first conductive part, for instance, consisting of the surface electrodes 6*a*, 6*b*, and 6*c*, is disposed in parallel with the rail-like electrode 1, and so as to contact with the projectile 3 and the armature 2. The surface electrodes 6*a*, 6*b*, and 6*c* are insulated each other by the insulation layer 8. The first conductive part is divided into three, that is, the first surface electrodes 6*a*, 6*b*, and 6*c*, in the acceleration direction of the projectile. A numeral 2 designates an armature constituted of an arc (hereinafter described as arc). A numeral 3 designates a projectile, which is accelerated and moved in the driving direction 5. The entrance of the projectile is the part 12, and the exit thereof is the part 13. The second conductive part, for instance, the backward side electrode 7, is juxtaposed on the opposite side of the surface electrodes 6*a*, 6*b*, and 6*c* of the rail-like electrode 1, which is insulated from the surface electrodes by the insulation layer 8. The arc blowing holes 9*a*, 9*b*, and 9*c* are installed at the surface electrodes 6*a*, 6*b*, and 6*c*, respectively. The bridging ports 10*a*, 10*b*, and 10*c* are installed at the insulation layer 8. When electric current flows in the backward side electrode 7, the arc 2 on the surface electrodes 6*a*, 6*b* and 6*c* enters in the arc blowing holes 9*a*, 9*b*, and 9*c* and the bridging ports 10*a*, 10*b*, and 10*c*, by which one of the surface electrodes 6*a*, 6*b*, and 6*c* and the backward side electrode 7 are in conductive state. The parts 14*a* and 14*b* are side walls.

Figure 2:
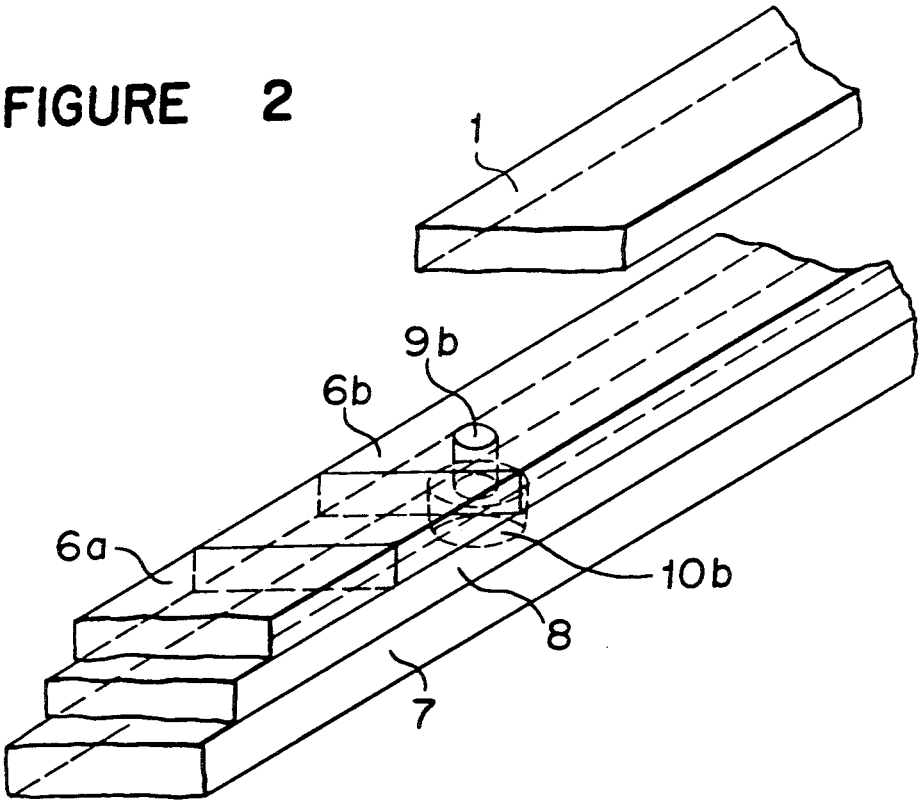
FIG. 2 is a perspective view showing an embodiment of an enlarged part of the electromagnetic rail launcher according to the present invention.

FIG. 2 is a partially cutaway perspective view showing the arc blowing hole 9*b*, and the bridging port 10*b*. The space in which the arc 2 runs between the rail-like electrodes 1, and the surface electrodes 6*a*, 6*b*, and 6*c*, is formed by the side walls 14*a* and 14*b* made of an insulation material. In this embodiment, the side walls 14*a*, and 14*b* surround the backward side electrode 7, but, may be extended up to the surface electrodes 6*a*, 6*b*, and 6*c*.

Figure 3A:
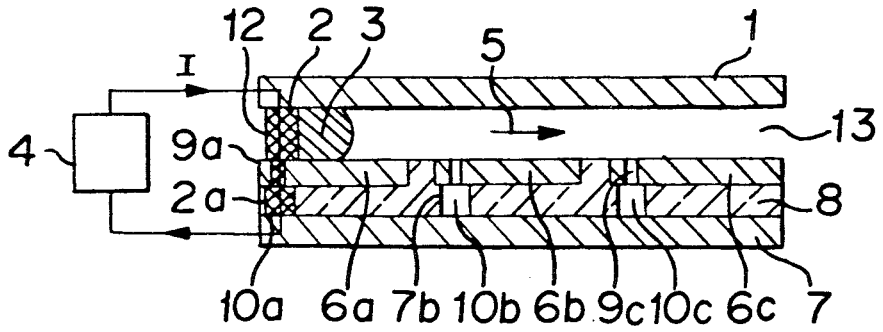
FIGS. 3A to 3D are explanatory diagrams showing a timewise change of a flow of an electric current.
Figure 3B:
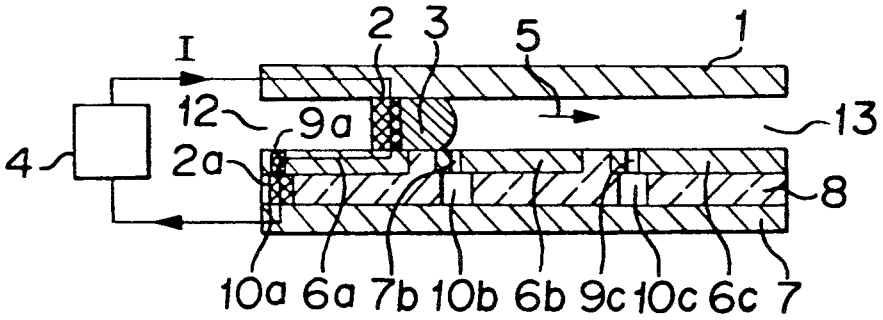
Figure 3C:
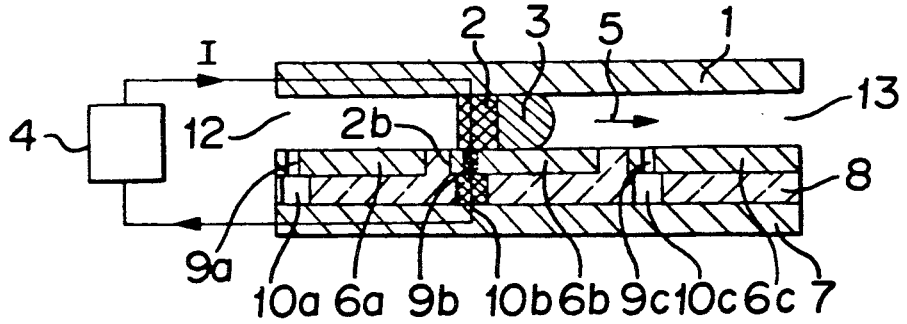
Figure 3D:
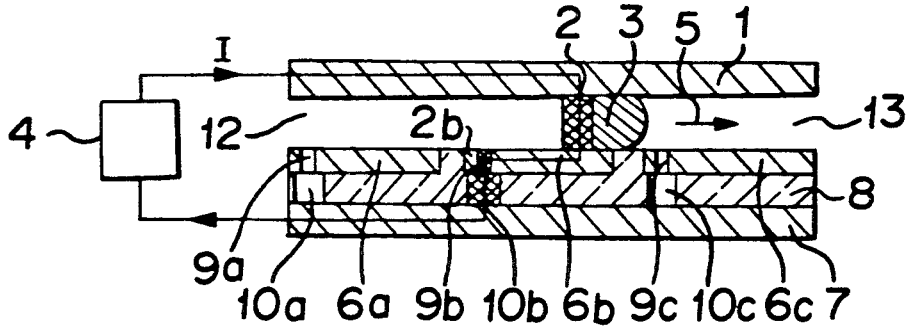

Next explanation will be given to the operation. FIGS. 3A to 3D are explanatory diagrams successively showing the operation of an electromagnetic rail launcher. A circuit is formed in which the power source 4 is connected to the side of the entrance 12 of the rail-like electrode 1 and the background side electrode 7. First of all, when an electric current is flown between these electrodes 1 and 7, as shown in FIG. 3A, a part of the arc 2, 2*a* at the rear side of the projectile 3, enters in the arc blowing hole 9*a*, and the bridging port 10*a*, and the electric current flows from the rail-like electrode 1, to the arc 2, to the part of the arc 2*a*, and to the backward side electrode 7, and returns to the power supply source 4. By the interaction between the electric current and a magnetic field generated by the electric current, the projectile 3 is accelerated and moved in the direction of the arrow mark 5. Next, when the projectile 3 and the arc 2 proceed to the position shown in FIG. 3B, the part of the arc 2*a* is still retained in the arc blowing hole 9*a* and the bridging port 10*a*, and the electric current, as shown by the arrow mark of FIG. 3B, flows from the rail-like electrode 1 to the arc 2, to the surface electrode 6*a*, to the part of the arc 2*a*, and to the backward side electrode 7. When the projectile 3 and the arc 2 are moved on the surface electrode 6*b*, as shown in FIG. 3, since the surface electrode 6*a* and the surface electrode 6*b* are insulated by the insulation layer 8, the part of the arc 2*a* is automatically extinguished, the arc 2 enters in the arc blowing hole 9*b*, and the bridging port 10*b*, and a part of the arc 2*b* is formed. As the result, the electric current, as shown by the arrow mark of FIG. 3C, flows from the rail-like electrode 1, to the arc 2, to the part of the arc 2*b*, and to the backward side electrode 7. When the projectile 3 and the arc 2 proceed on the surface electrode 6*b*, as shown in FIG. 3D, the electric current flows from the rail-like electrode 1, to the arc 2, to the surface electrode 6*b*, to the part of the arc 2*b*, and to the backward side electrode 7. The same operation is performed when the projectile 3 and the arc 2 are moved to the surface electrode 6*c*.

Figure 4A:
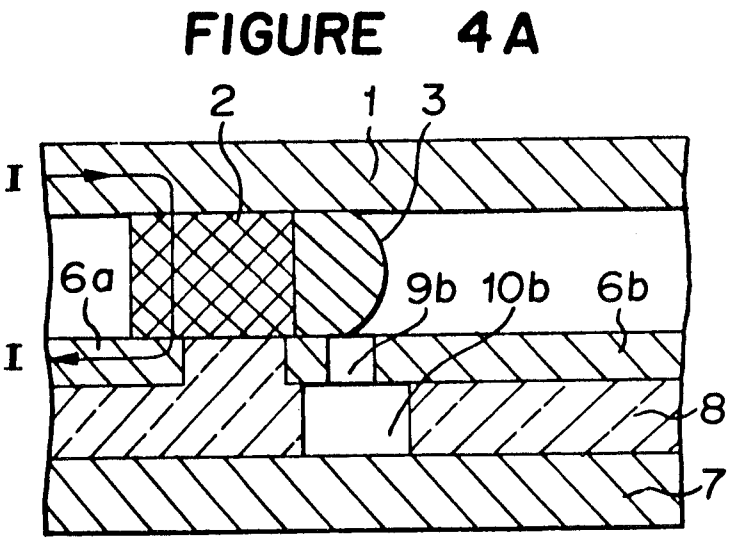
FIGS. 4A to 4D are explanatory diagrams showing a timewise change of the movement of the arc and a flow of the electric current in details concerning an embodiment of the present invention.
Figure 4B:
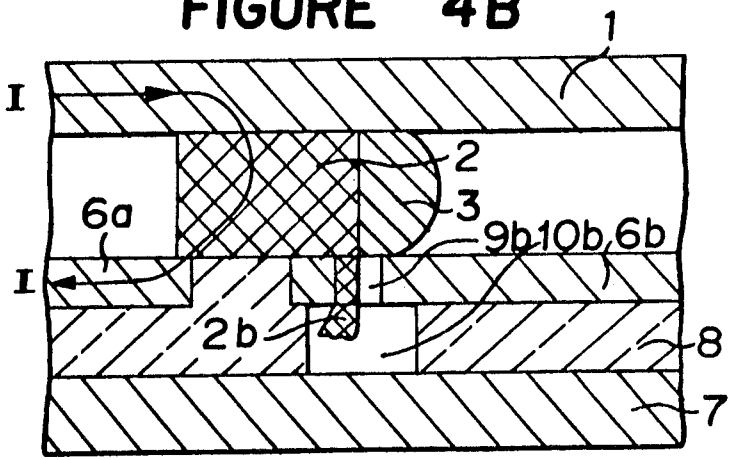
Figure 4C:
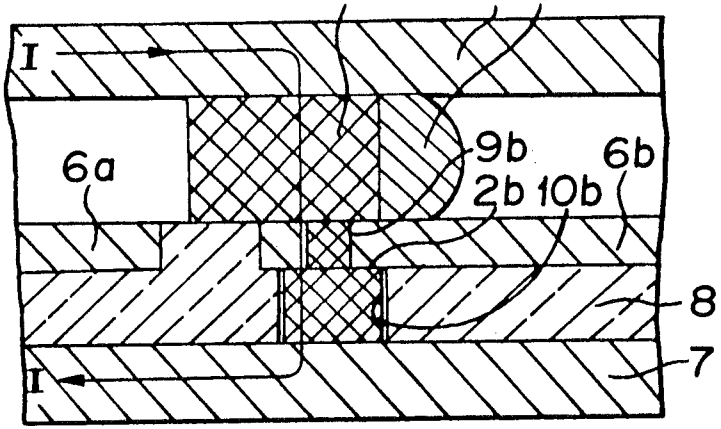
Figure 4D:
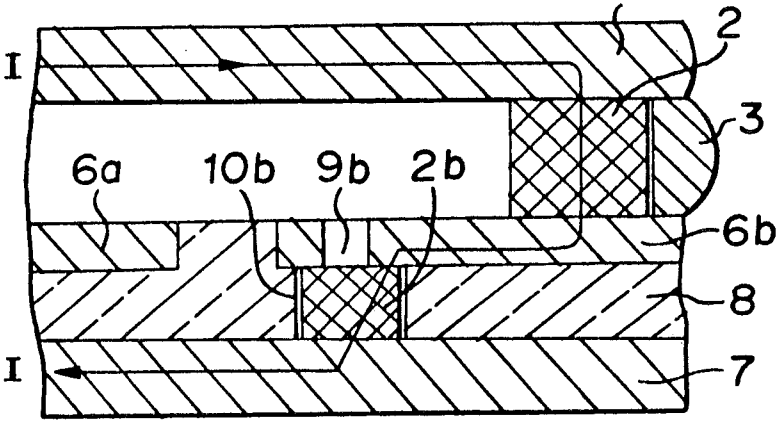

FIGS. 4A to 4D are explanatory diagrams showing in details by magnifying the process in which a part of the arc 2 enters in the bridging port 10*b*, forming an electric current passage, as the arc 2 moves. When the arc 2 proceeds from the position in FIG. 4A to that in FIG. 4D, a part of the arc enters from the arc blowing hole 9*b* to the bridging hole 10*b*. In FIG. 4C, by the part of the arc 2*b*, the surface electrode 6*b* and the backward side electrode 7 are in conductive state. When the arc 2 leaves from the surface electrode 6*a*, the electric current flows as shown by the arrow mark in FIG. 4C. When the arc 2 proceeds further, as shown in FIG. 4D, the part of the arc 2*b* is retained between the surface electrode 6*b* and the backward side electrode 7, and the electric current I flows as shown by the arrow mark in FIG. 4D.

As stated above, according to the above embodiment, one of the juxtaposed rail-like electrodes is divided into three surface electrodes 6*a*, 6*b*, and 6*c*, which are insulated each other by the insulation layer 8. Holes are installed at the surface electrodes 6*a*, 6*b*, and 6*c*, and the insulation layer 8. A part of the arc 2 which runs through the surface electrodes 6*a*, 6*b*, and 6*c*, is blown out of these holes. By this part of the arc, the backward side electrode 7 and the surface electrodes 6*a*, 6*b*, and 6*c* which are insulated with the backward side electrode 7 by the insulation layer 8, get in conductive state. Therefore, for instance, in FIG. 3D, no electric voltage is applied between the rail-like electrode 1 and the surface electrodes 6*a* and 6*c*, except the surface electrode 6*b*, which contact with the arc 2. Therefore the surface electrode except the surface electrode 6*b* which contact with the arc 2, no insulation destruction is caused, no arc is generated, and no electric current is shunted. Therefore, the drive of the arc 2 and the projectile 3 is efficiently carried out. Furthermore, since as for the electric conduction between the surface electrode 6*b* and the backward side electrode 7, the part of the arc 2*b*, which is a part of the arc 2, is utilized, no special switch is necessary to be installed between the surface electrodes 6*a*, 6*b*, and 6*c* and the backward side electrode 7.

Furthermore, when the sectional areas of the bridging ports 10*a*, 10*b*, and 10*c* installed at the insulation layer 8, are constituted as larger than the sectional areas of the juxtaposed arc blowing holes 9*a*, 9*b* and 9*c*, the electric resistance of the surface electrodes 6*a*, 6*b* and 6*c* and the arc generated in the holes, becomes smaller, which enhances the efficiency.

When the intervals among the segmented surface electrodes 6*a*, 6*b*, and 6*c* in the acceleration direction of the projectile 3, are shortened than the expanded length in the running direction of the arc 2, the arc can smoothly be shifted, in shifting among the segmented surface electrodes 6*a*, 6*b*, and 6*c*. The expanded length in the running direction of the arc 2, can be predetermined by the electric current and the velocity.

In the above embodiment, explanation is given to the case in which the number of the surface electrode is three. However, this invention has the same effect in case of two surface electrodes, or four electrodes or more.

Figure 5A:
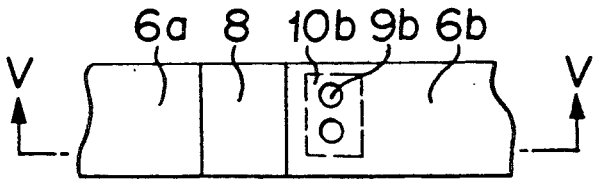
FIGS. 5A and 5B are a top view and a sectional diagram, respectively, showing an important part of another embodiment of an electromagnetic rail launcher of this invention.
Figure 5B:
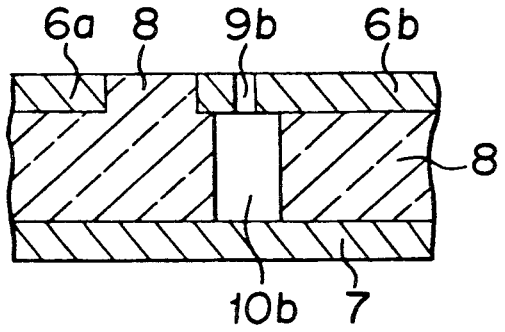

FIGS. 5A and 5B show another embodiment of the present invention by enlarging a part of an electromagnetic rail launcher. FIG. 5A is a top view which eliminates the rail-like electrode 1, and FIG. 5B is a sectional diagram taken along the line V—V of FIG. 5A. In the former embodiment, one arc blowing hole is installed at one surface electrode. However as shown in this embodiment, there may be two arc blowing holes or more. The number of the bridging port may be one for one arc blowing hole, or, single or plural for a plurality of arc blowing holes, as shown in FIGS. 5A and 5B. The shapes of the arc blowing hole and the bridging port are not necessarily to be a circle, and may be quadrilateral, ditch-like shape, and other shapes with the same effect.

Figure 6A:
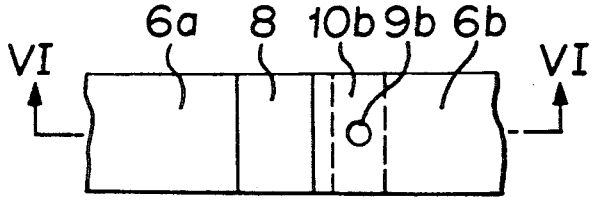
FIGS. 6A and 6B and FIGS. 7A and 7B are top views and sectional diagrams respectively, showing important parts of the other embodiments of this invention.
Figure 6B:
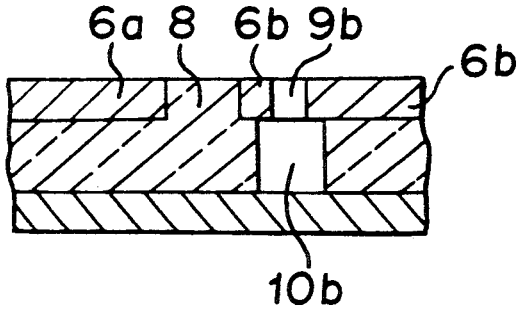
Figure 7A:
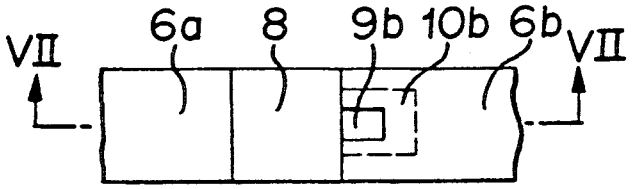
Figure 7B:
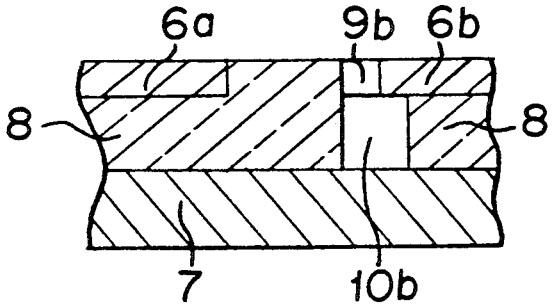

FIGS. 6A and 6B show an example in which the bridging port 10*b* is constituted in a ditch-like shape of which width is extended to the width of the surface electrode 6*b*. FIG. 6A is a top view which eliminates the rail-like electrode 1, and FIG. 6B is a sectional diagram taken along the line of VI—VI in FIG. 6A. In this embodiment the same effect is obtained as in the above embodiments. Furthermore, the arc blowing hole 9*b*, as shown in FIGS. 7A and 7B, may be in the shape in which one end of the surface electrode is cut out, with the same effect.

Figure 8:
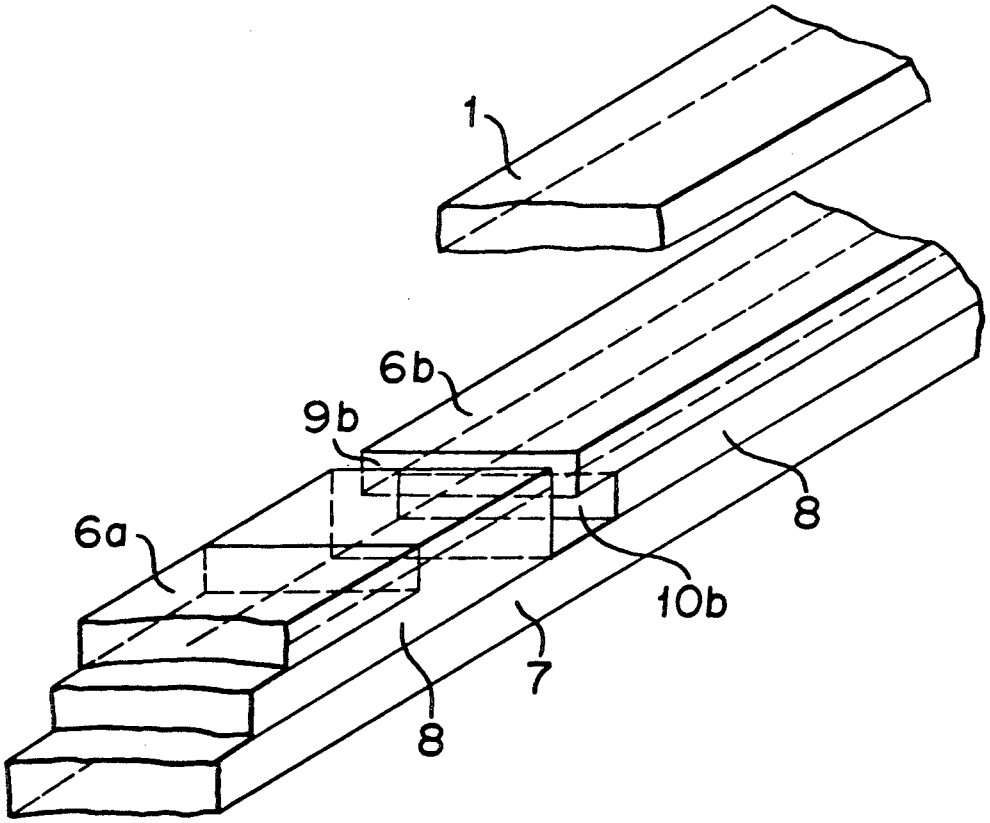
FIG. 8 is a perspective view showing an important part of the other embodiment.

Furthermore, as shown in FIG. 8, the arc blowing hole, may be constituted by providing a space between a surface electrode and a part which insulates the adjacent surface electrodes, with the same effect.

In these embodiment, although not shown in the drawings, sidewalls are installed which surround the rail-like electrode and the surface electrodes.

Figure 9:
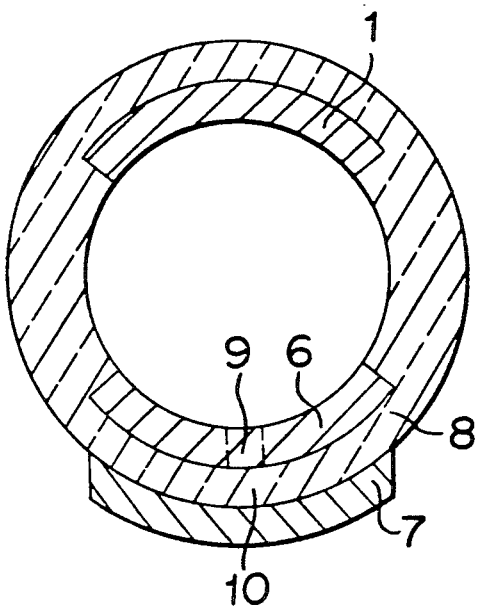
FIG. 9 is the sectional diagram showing the other embodiment.
Figure 10:
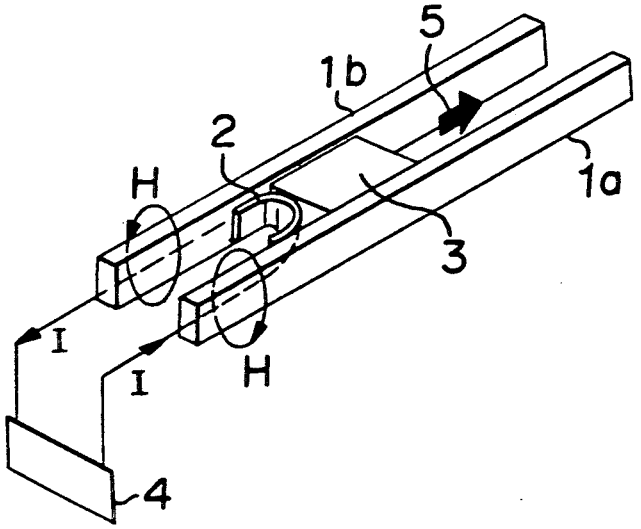
FIGURE 10 (PRIOR ART)
FIG. 10 is a construction diagram showing a conventional electromagnetic rail launcher.

In the above embodiment, the cross section perpendicular to the running direction, of the space which is forms by the rail-like electrode, the surface electrodes, and the sidewalls. However, as shown in FIG. 9, the cross section of the above space may be a circle. This invention can be constituted in any cross section of the space in which a projectile having a certain shape can run without hindrance, with the same effect as the above embodiments.

As stated above, according to the present invention, in the electromagnetic rail launcher, which is provided with a plurality of rail-like electrodes arranged in parallel, an armature disposed so that these electrodes are electrically shortcircuited, and which accelerates a projectile by an electromagnetic force, the device comprises, the first conductive part at least one of electrodes of which contacts with the armature, and the second conductive parts which is electrically insulated with the first conductive part. The first conductive part is segmented in plural parts in the acceleration direction of the projectile, which are electrically insulated each other. At least one hole is provided for each of the segmented first conductive part. When an electric current is flown in the second conductive part, the first conductive part and the second conductive part are bridged by an arc, through the hole. By this means, in the acceleration process of the projectile and the armature, the device can prevent the generation of a high electric voltage between the rail-like electrode on the side of introduction of the electric current, with respect to the moving armature, and can prevent the generation of the insulation destruction between the rail-like electrodes.

We claim:

1. An electromagnetic rail launcher adapted to accelerate a projectile by an electromagnetic force which comprises:

a plurality of rail-like electrodes; and an armature being installed so as to shortcircuit the plurality of rail-like electrodes;

at least one of said plurality of electrodes being consisted of a first conductive part which contacts with the armature and a second conductive part which is electrically insulated with the first conductive part;

said first conductive part being segmented in a plurality of segmented first conductive parts which are insulated with each other, in an acceleration direction of the projectile;

each of said plurality of the segmented first conductive parts having at least one hole through which the first conductive part and the second conductive part are bridged by an arc, when a current flows in the second conductive part.

* * * * *

UNITED STATES PATENT AND TRADEMARK OFFICE

CERTIFICATE OF CORRECTION

PATENT NO. : 5,133,241

DATED : July 28, 1992

INVENTOR(S) : Koyama et al.

It is certified that error appears in the above-identified patent and that said Letters Patent is hereby corrected as shown below:

In Claim 1, col. 6, lines 26 to 27, replace "consisted" with --comprised--; at col. 6, line 28, delete "with"; at col. 6, line 29, replace "with" with --from--; and at col. 6, line 33, replace "with" with --from--.

Signed and Sealed this

Tenth Day of August, 1993

*Attest:*

Michael K. Kirk

MICHAEL K. KIRK

*Attesting Officer*

*Acting Commissioner of Patents and Trademarks*